US009164441B2

(12) United States Patent
Tamaki et al.

(10) Patent No.: US 9,164,441 B2
(45) Date of Patent: Oct. 20, 2015

(54) FIXING UNIT AND IMAGE FORMING APPARATUS

(71) Applicant: KONICA MINOLTA, INC., Chiyoda-ku, Tokyo (JP)

(72) Inventors: Kenji Tamaki, Tokorozawa (JP); Takeshi Tamada, Toyohashi (JP); Kenji Yamamoto, Hachioji (JP); Kosuke Sasaki, Yokohama (JP); Shohei Otsu, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/282,858

(22) Filed: May 20, 2014

(65) Prior Publication Data

US 2014/0348528 A1 Nov. 27, 2014

(30) Foreign Application Priority Data

May 22, 2013 (JP) ..... 2013-107585

(51) Int. Cl.
*G03G 15/20* (2006.01)

(52) U.S. Cl.
CPC ..... *G03G 15/205* (2013.01)

(58) Field of Classification Search
CPC ..... G03G 15/205
See application file for complete search history.

(56) References Cited

U.S. PATENT DOCUMENTS

| | | | | |
|---|---|---|---|---|
| 6,177,657 | B1 | 1/2001 | Takata et al. | |
| 8,036,558 | B2 | 10/2011 | Nakashima | |
| 2009/0245846 | A1* | 10/2009 | Nakashima | 399/70 |
| 2010/0247131 | A1* | 9/2010 | Sato et al. | 399/70 |
| 2013/0272738 | A1* | 10/2013 | Kawakami et al. | 399/69 |

FOREIGN PATENT DOCUMENTS

| | | | |
|---|---|---|---|
| JP | 07261475 | A | 10/1995 |
| JP | 09080961 | A | 3/1997 |
| JP | 10091017 | A | 4/1998 |
| JP | 11339930 | A | 12/1999 |
| JP | 11344899 | A | 12/1999 |
| JP | 2003345169 | A | 12/2003 |
| JP | 2009-237070 | A | 10/2009 |
| JP | 2009237070 | A | 10/2009 |

OTHER PUBLICATIONS

Japanese Office Action (and English translation thereof) dated May 26, 2015, issued in counterpart Japanese Application No. 2013-107585.

* cited by examiner

*Primary Examiner* — Sandra Brase
(74) *Attorney, Agent, or Firm* — Holtz, Holtz, Goodman & Chick PC

(57) ABSTRACT

An image forming apparatus is provided with a fixing unit in which flickers can be effectively reduced while inhibiting electric current imbalance. The fixing unit comprises a fixing heater, a switching unit for switching the fixing heater on/off with an AC power source, and a control unit which controls the switching unit to switch in units of the half wave period of the AC power source AC, and a storing unit for storing a plurality of energization patterns which define the ways of performing the switch control. Each energization pattern corresponds to a control cycle which contains a three or more odd number of the half wave periods each of which is either an OFF period and an ON period, and all the half wave periods of the smaller in number of the ON periods and the OFF periods are not successively arranged.

5 Claims, 5 Drawing Sheets

| Energization Pattern No. | ON Periods/ Ctrl Periods | Duty(%) | Evaluation Results | |
|---|---|---|---|---|
| | | | ≧1000W | <1000W |
| 1 | 8/9 | 88.89 | × | ○ |
| 2 | 9/11 | 81.8 | ○ | ○ |
| 3 | 5/7 | 71.43 | × | × |
| 4 | 5/7 | 71.43 | ○ | - |
| 5 | 2/3 | 66.67 | ○ | ○ |
| 6 | 4/7 | 57.14 | × | - |
| 7 | 4/7 | 57.14 | ○ | ○ |

FIXING UNIT AND IMAGE FORMING APPARATUS

CROSS-REFERENCE TO RELATED APPLICATIONS

The present application claims priority under 35 U.S.C. §119 to Japanese Patent Application No. 2013-107585, filed on May 22, 2013. The contents of this application are herein incorporated by reference in their entirety.

FIELD OF THE INVENTION

The present invention relates to a fixing unit and an image forming apparatus.

DESCRIPTION OF THE RELATED ART

Heretofore, image forming apparatuses such as printers, copying machines and so forth are known as electrophotographic systems. Such an image forming apparatus forms an image by performing a series of processes which includes transferring an image to a sheet, and then fixing the image to the sheet. The image forming apparatus is provided with a fixing unit for performing a fixing process. This fixing unit is provided with a fixing heater. For example, the fixing heater may be a halogen lamp.

When the image forming apparatus is left in a low temperature environment, for example, at the night in winter, the fixing heater is also cooled to a low temperature so that the heater resistance is lowered. If the fixing heater is turned on in this condition, a rush current tends to increase and cause further flickers. The flicker is a phenomenon such as fluctuating operation of a device, for example, a lighting device connected to the same AC power source as the image forming apparatus due to rapid voltage changes occurring each time the fixing heater is turned on/off. In addition, since the frequency of turning on/off the fixing heater has to increase for inhibiting temperature ripples, the influences of flickers become further conspicuous.

For example, Japanese Patent Published Application No. 2009-237070 discloses an image forming apparatus which can inhibit flickers. This image forming apparatus includes a switching unit for switching on/off the conductive state between an AC power source and a fixing heater, and a control unit for controlling the switching unit every half wave period of the AC power source. This control unit is provided with a plurality of energization patterns in correspondence with different control cycles each of which is an integer multiple of the half wave period to control the switching unit on the basis of the energization patterns. In this case, each energization pattern includes a unit control cycle consisting of ON periods in which the conductive state is turned on and OFF periods in which the conductive state is turned off, such that all the half wave periods of the smaller in number of the ON periods and the OFF periods are not successively arranged.

However, depending upon the energization pattern, there may be an imbalance in the flowing direction of electric current which is not desired for a switching device of the switching unit or the like.

The present invention has been made in order to solve the problems as described above. It is an object of the present invention therefore to provide a technique for inhibiting the imbalance in the flowing direction of electric current and effectively reducing flickers.

SUMMARY OF THE INVENTION

To achieve at least one of the abovementioned objects, a fixing unit reflecting one aspect of the present invention comprises: a fixing heater configured to be turned on by energization and perform thermal fixing; a power line configured to connect the fixing heater with an AC power source; a switching unit configured to switch between an off-state in which the fixing heater is disconnected from the AC power source to stop energization and an on-state in which the fixing heater is connected with the AC power source to perform energization; and a control unit configured to control the switching unit to switch in accordance with one of a plurality of energization patterns each of which defines arrangement of the on-state and the off-state in units of the half wave period of the AC power source. Particularly, each of the energization patterns consists of a three or more odd number of the half wave periods arranged in one control cycle, and all the half wave periods of the smaller in number of the ON periods corresponding to the on-state and the OFF periods corresponding to the off-state are not successively arranged.

In accordance with the present invention as described above, it is preferred that the fixing heater consists of a plurality of heaters which are connected in parallel to the AC power source respectively through the power line, that the switching unit is provided separately for each of the plurality of heaters and that, when the plurality of heaters are turned on at the same time, the control unit controls the switching unit to turn on/off the plurality of heaters in accordance with different ones of the energization patterns respectively.

Furthermore, it is preferred that if the length of one control cycle is seven times the half wave period, the energization pattern having this control cycle comprises: a first block which consists of three half wave periods including one half wave period of the smaller in number of the ON periods and the OFF periods; and two or more second blocks each of which consists of two half wave periods and that, of the second blocks, the number of blocks including a half wave period of the smaller in number of the ON periods and the OFF periods is one or two.

DETAILED DESCRIPTION OF THE PREFERRED EMBODIMENT

Figure 1:
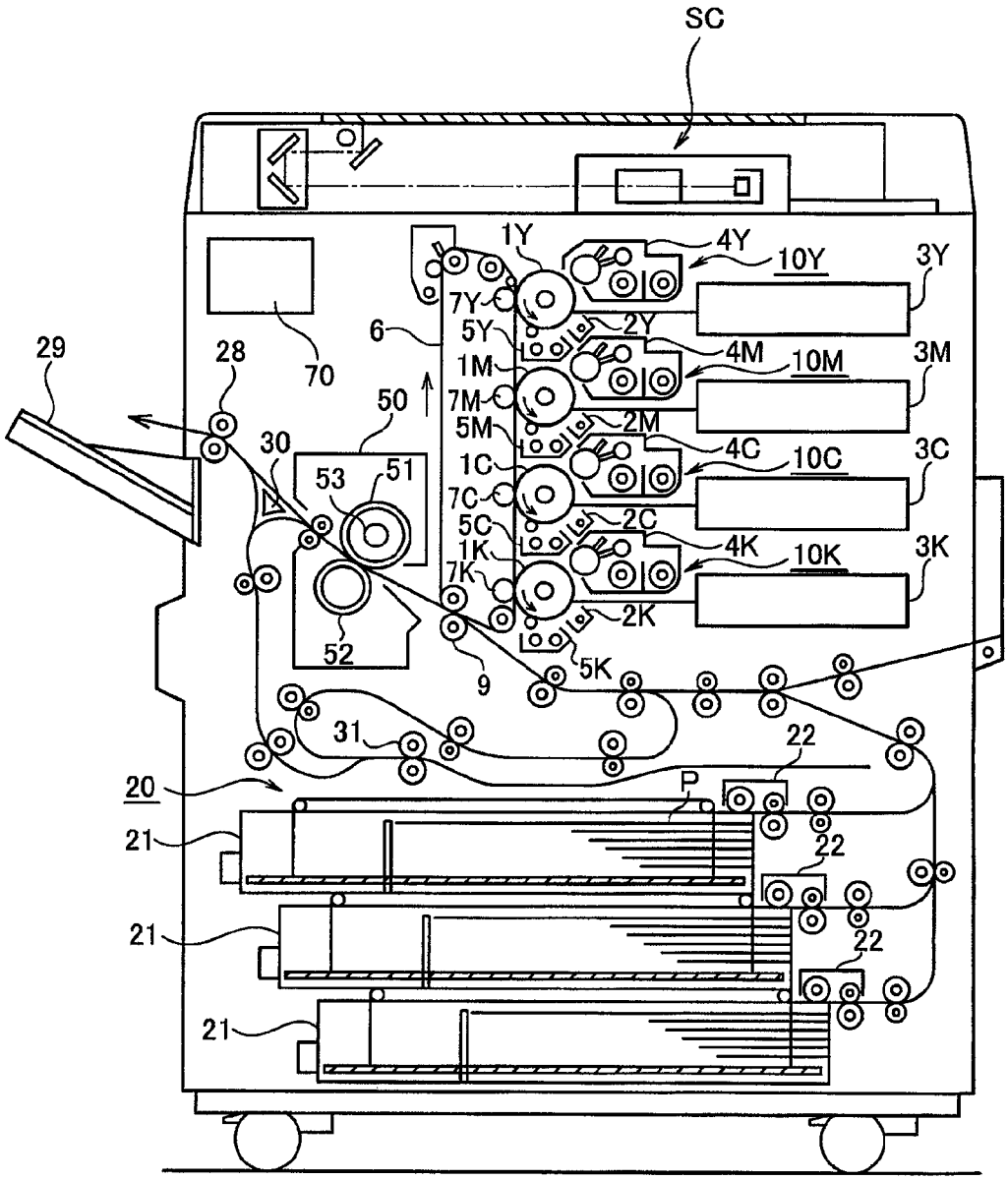
FIG. 1 is a view for schematically showing the configuration of an image forming apparatus according to a first embodiment.

FIG. 1 is a view for schematically showing the configuration of an image forming apparatus according to the present embodiment. This image forming apparatus is a copying machine which is an electrophotographic image forming apparatus called a tandem color image forming apparatus. The tandem color image forming apparatus includes a plurality of photoreceptor drums vertically arranged in contact with one intermediate transfer belt to form full-color images.

The image forming apparatus consists mainly of an original reading unit SC, four image forming units 10Y, 10M, 10C and 10K, a fixing unit 50, and a control unit 70, which are installed within one housing.

The original reading unit SC scans and exposes the image of an original with an optical system of a scanning exposing device, and reads the reflected light therefrom with a line image sensor to obtain image signals. The image signals are processed by performing A/D conversion, shading compensation, data compression and so on, and input to the control unit 70 as image data. Incidentally, the image data input to the control unit 70 is not limited to the image data as captured by the original reading unit SC, but can be the data for example as received from another image forming apparatus, a personal computer or the like connected to the image forming apparatus, or stored in a portable recording medium such as a USB memory.

The image forming units 10Y, 10M, 10C and 10K correspond to a device for forming yellow (Y) images, a device for forming magenta (M) images, a device for forming cyan (C) color images, and a device for forming black (K) images respectively.

The image forming unit 10Y is provided with a photoreceptor drum 1Y, and a charging unit 2Y, an optical writing unit 3Y, a development apparatus 4Y and a drum cleaner 5Y which are arranged around the photoreceptor drum 1Y. Likewise, the other image forming units 10M, 10C and 10K are provided with photoreceptor drums 1M, 1C and 1K, and charging units 2M, 2C and 2K, optical writing units 3M, 3C and 3K, development apparatuses 4M, 4C and 4K, drum cleaners 5M, 5C and 5K which are arranged around the photoreceptor drums 1M, 1C and 1K respectively.

The surfaces of the photoreceptor drums 1Y, 1M, 1C and 1K are uniformly charged with electricity by the charging units 2Y, 2M, 2C and 2K, and the optical writing units 3Y, 3M, 3C and 3K performs a scanning exposure process to form latent images on the photoreceptor drums 1Y, 1M, 1C and 1K. The development apparatuses 4Y, 4M, 4C and 4K then make visible the latent images on the photoreceptor drums 1Y, 1M, 1C and 1K by developing the images with toners. Predetermined color images (toner images) are thereby formed on the photoreceptor drums 1Y, 1M, 1C and 1K respectively corresponding to yellow, magenta, cyan and black. The images formed on the photoreceptor drums 1Y, 1M, 1C and 1K are transferred to a predetermined location of an intermediate transfer belt 6, which is an intermediate transfer member in the form of an endless belt, through first transfer rollers 7Y, 7M, 7C and 7K.

After transferred to the intermediate transfer belt 6, the predetermined color images are transferred by a second transfer roller 9 to a sheet P conveyed with a predetermined timing by a paper feed unit 20 to be described below. This second transfer roller 9 is a rotary member in the form of a roller and arranged in contact with the intermediate transfer belt 6 under pressure to form a nip site ("transfer nip site") therebetween to transfer an image to the sheet P during conveyance.

The paper feed unit 20 conveys a sheet P along a conveyance route. Sheets P are stored in paper feed trays 21, extracted from the paper feed tray 21 and transferred to the conveyance route by paper feed units 22. This conveyance route is provided with a plurality of conveyance units for conveying sheets P in the upstream side of the transfer nip site. Each conveyance unit consists of a pair of rollers which are in contact with each other under pressure, and at least one of the rollers is rotationally driven by an electric motor which is a driving mechanism. Then, each conveyance unit holds a sheet P between the pair of rollers which are rotated to convey the sheet P. Meanwhile, in place of a pair of rollers, any other appropriate combination such as a combination of belts, a combination of a belt and a roller or the like combination can be used as a pair of rotary members serving as a conveyance unit.

The fixing unit 50 is a device which performs a fixing process for fixing an image to a sheet P to which the image is transferred. The fixing unit 50 is provided with a pair of fixing members which are arranged in contact with each other under pressure to form a nip site (fixing nip site) therebetween, and a heating device for heating the fixing members. The pair of fixing members can, for example, be fixing rollers 51 and 52. The fixing rollers 51 and 52 are rotatably installed respectively, and at least one of them (for example, the fixing roller 52) is rotatably driven by a drive motor (not shown in the figure) serving as a driving means. The heating device can be a fixing heater 53 which is turned on by energization such as a halogen lamp. The fixing unit 50 conveys a sheet P and fixes an image to the sheet P by pressure fixing with the pair of fixing rollers 51 and 52 and thermal fixing with the fixing heater 53.

After the fixing unit 50 processes the sheet P by the fixing treatment, the sheet P is discharged by discharging rollers 28 to a catch tray 29 which is attached to the external side of the housing. In the case where an image is to be formed also on the back side of the sheet P, the sheet P with the image formed on the front side is conveyed to reversing rollers 31 located below by a switching gate 30. The reversing rollers 31 hold the tail end of the sheet P which is conveyed therebetween and then reverses the sheet P by sending back it to a refeeding conveyance route. The sheet P sent back to the refeed conveyance route is then returned to the transfer site again by a plurality of conveyance rollers provided for refeeding sheets.

The control unit 70 is responsible for integrally controlling the image forming apparatus and can be implemented with a microcomputer mainly including a CPU, a ROM, a RAM, and an I/O interface. The control unit 70 forms an image on a sheet P by controlling the image forming units 10Y, 10M, 10C and 10K, the fixing unit 50 and the like.

Figures 2, 4:
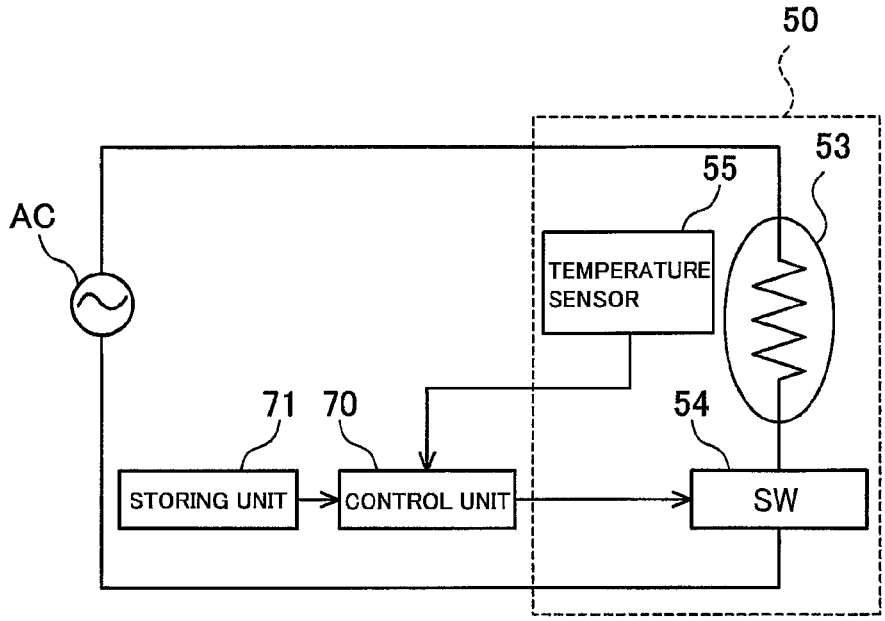
FIG. 2 is a block diagram showing the structure of the fixing unit shown in FIG. 1.
FIG. 4 is a view for explaining the energization patterns shown in FIG. 3.

FIG. 2 is a block diagram showing the structure of the fixing unit 50 in accordance with a first embodiment of the present invention. The control unit 70 of the present embodiment serves also to control the fixing unit 50. Specifically speaking, the control unit 70 controls the fixing heater 53 to turn on/off on the basis of a predetermined target temperature.

As shown in the same figure, the fixing heater 53 is connected through a power line to an AC power source AC which is provided in an environment such as an office where the image forming apparatus 1 is used. The fixing heater 53 of the present embodiment consists of a single heater.

The power line is provided with a switching unit 54 which switches between an off-state in which the power line is broken and an on-state in which the power line is connected. The on/off state of this switching unit 54 is controlled by the control unit 70. The switching unit 54 can be implemented, for example, with a triac (bidirectional thyristor). As described below, however, the switching unit 54 may be implemented with a transistor, an IGBT or another switching device as long as switch control can be performed in units of the half wave period of the AC power source AC with a zero crossing as a base point.

The control unit 70 receives a detection signal which is input from a temperature sensor 55 for detecting the temperature of the fixing heater 53. The control unit 70 determines whether to turn on/off the fixing heater 53 on the basis of the temperature detected by the temperature sensor 55.

Specifically, the control unit 70 obtains a temperature difference calculated by subtracting a target temperature from the temperature detected by the temperature sensor 55, and determines whether to turn on or off the fixing heater 53 on the basis of the temperature difference. When turning on the fixing heater 53, the control unit 70 controls the switching unit 54 to switch between the on-state and the off-state in accordance with a duty cycle corresponding to the temperature difference. The switch control is performed in units of the half wave period of the AC power source AC. If the AC power source AC is 50 Hz, the half wave period is 10 msec so that the control unit 70 outputs an ON signal or an OFF signal to the switching unit 54 every 10 msec. In the case where a triac is used as the switching unit 54 as described above, if the switching unit 54 receives an ON signal from the control unit 54 with the timing of the zero crossing of the AC power source AC, the switching unit 54 is switched to the on-state. Conversely, if the switching unit 54 receives an OFF signal from the control unit 54 with the same timing, the switching unit 54 is switched to the off-state.

A plurality of energization patterns are stored in a storing unit 71 for defining the ways of performing the switch control. The control unit 70 repeats the switch control in accordance with one of the energization patterns through the period during which the fixing heater 53 is turned on. An energization pattern consists of an integral multiple of the half wave periods arranged in one control cycle. The energization pattern is provided in units of the half wave periods each of which is either an OFF period corresponding to the off-state of the switching unit 54 or an ON period corresponding to the on-state of the switching unit 54. The plurality of energization patterns stored in this storing unit 71 are provided in correspondence with a variety of duty cycles.

Figure 3:
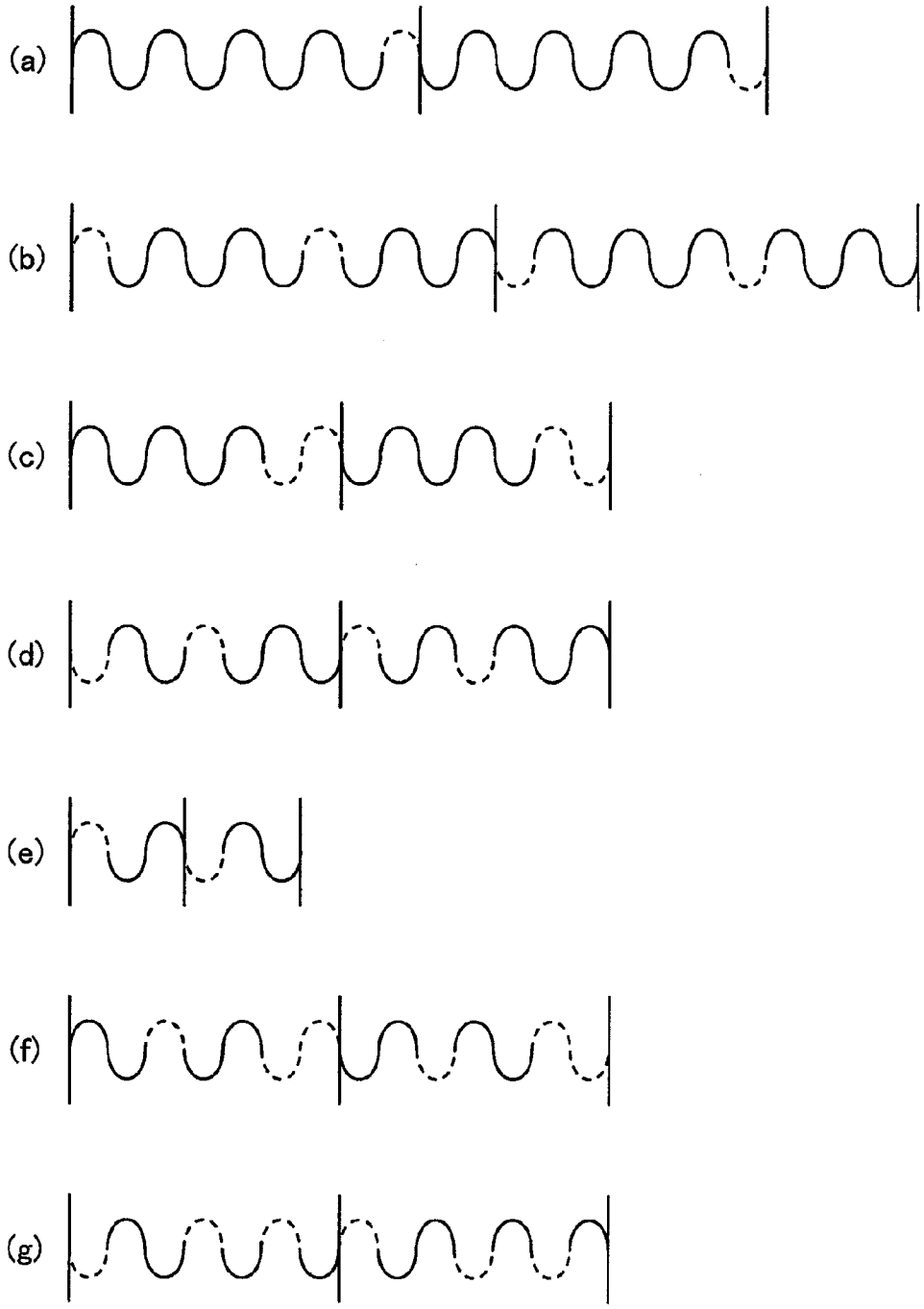
FIG. 3 is a view for explaining current wave forms corresponding to energization patterns.

In what follows, the energization patterns will be explained in detail. FIG. 3 is a view for explaining current wave forms corresponding to different energization patterns. FIG. 4 is a view for explaining the energization patterns shown in FIG. 3. In FIG. 3, ON periods are shown with solid line, and OFF periods are shown with broken line. Also, the energization pattern 1 through the energization pattern 7 shown in FIG. 4 correspond to the energization patterns depicted on the wave forms (a) through (g) shown in FIG. 3 respectively. "Evaluation results" shown in FIG. 4 are the results of evaluating flickers when the switch control is repeated predetermined times in accordance with each energization pattern (given in one control cycle). Each evaluation result is shown as "X" if the measurement value exceeds a predetermined value (for example, pst=1.0) and "○" if the measurement value does not exceed the predetermined value. The evaluation was performed unit with a fixing heater of a predetermined power no smaller than 1000 W and with a fixing heater of a predetermined power smaller than 1000 W respectively.

The energization pattern 1 consists of nine half wave periods including eight ON periods and one OFF period arranged in one control cycle (FIG. 3(*a*)). The duty cycle is 88.89%. One of the evaluation results of this energization pattern 1 is "x" so that the energization pattern 1 may not satisfy a flicker regulation.

The energization pattern 2 consists of eleven half wave periods including nine ON periods and two OFF periods arranged in one control cycle (FIG. 3(*b*)). The duty cycle is 81.6%. Both the evaluation results of this energization pattern 2 are "○", so that the energization pattern 2 can satisfy the flicker regulation.

Each of the energization patterns 3 and 4 consists of seven half wave periods including five ON periods and two OFF periods arranged in one control cycle (FIG. 3(*c*) and FIG. 3(*d*)). The duty cycle is 71.43%. The energization pattern 3 and the energization pattern 4 differ from each other in the ordinal relation of the ON periods and OFF periods. Both the evaluation results of this energization pattern 3 are "x", so that the energization pattern 3 may not satisfy the flicker regulation. On the other hand, while no data is given with the fixing heater of the predetermined power smaller than 1000 W, the energization pattern 4 can satisfy the flicker regulation with the fixing heater of the predetermined power no smaller than 1000 W.

The energization pattern 5 consists of three half wave periods including two ON periods and one OFF period arranged in one control cycle (FIG. 3(*e*)). The duty cycle is 66.67%. Both the evaluation results of this energization pattern 5 are "○", so that the energization pattern 5 can satisfy the flicker regulation.

Each of the energization patterns 6 and 7 consists of seven half wave periods including four ON periods and three OFF periods arranged in one control cycle (FIG. 3(*f*) and FIG. 3(*g*)). The duty cycle is 57.14%. The energization pattern 6 and the energization pattern 7 differ from each other in the ordinal relation of the ON periods and OFF periods. While no data is given with the fixing heater of the predetermined power smaller than 1000 W, the energization pattern 6 may not satisfy the flicker regulation with the fixing heater of the predetermined power no smaller than 1000 W. On the other hand, both the evaluation results of the energization pattern 7 are "○", so that the energization pattern 7 can satisfy the flicker regulation.

Through investigation of the energization patterns having various lengths of one control cycle and various sequential orders of ON/OFF periods as has been discussed above, the following rules are found in the energization patterns required for satisfying the flicker regulation. Of the examples shown in FIGS. 3 and 4, the energization patterns 2, 4, 5 and 7 satisfy the flicker regulation.

Specifically, each of the energization patterns consists of an odd number (three or more) of the half wave periods arranged in one control cycle, and each half wave period is either an OFF period corresponding to the off-state of the switching unit 54 or an ON period corresponding to the on-state of the switching unit 54. Also, when the flicker regulation is satisfied, all the half wave periods of the smaller in number of the ON periods and the OFF periods are not successively arranged. Preferably, any two periods of the smaller are separated in the sequence of the half wave periods.

Furthermore, if the length of one control cycle is seven times the half wave period, the energization pattern satisfies the following requirements. Such an energization pattern consists of a first block which consists of three half wave periods including one half wave period of the smaller in number of the ON periods and the OFF periods, and two or more second blocks each of which consists of two half wave periods. Of the second blocks, the number of blocks including a half wave period of the smaller in number of the ON periods and the OFF periods is one or two.

The examples shown in FIG. 3 include the energization patterns 2, 4 and 7 as the energization patterns which satisfy the flicker regulation and consist of seven or more half wave periods corresponding to one control cycle respectively. For example, the energization pattern 2 includes the first three half wave periods as a first block which consists of three half wave periods including one half wave period of the smaller in number of the ON periods and the OFF periods. The energization pattern 2 also includes subsequent eight half wave periods as four second blocks each of which consists of two half wave periods. In this case, the number of second blocks including a half wave period of the smaller in number of the ON periods and the OFF periods is one.

Also, the energization pattern 7 includes the first three half wave periods as a first block which consists of three half wave periods including one half wave period of the smaller in number of the ON periods and the OFF periods. The energization pattern 7 also includes subsequent four half wave periods as two second blocks each of which consists of two half wave periods. In this case, the number of second blocks including a half wave period of the smaller in number of the ON periods and the OFF periods is two.

The storing unit 71 as described above stores energization patterns which satisfy the above requirements for respective duty cycles.

Figure 5:
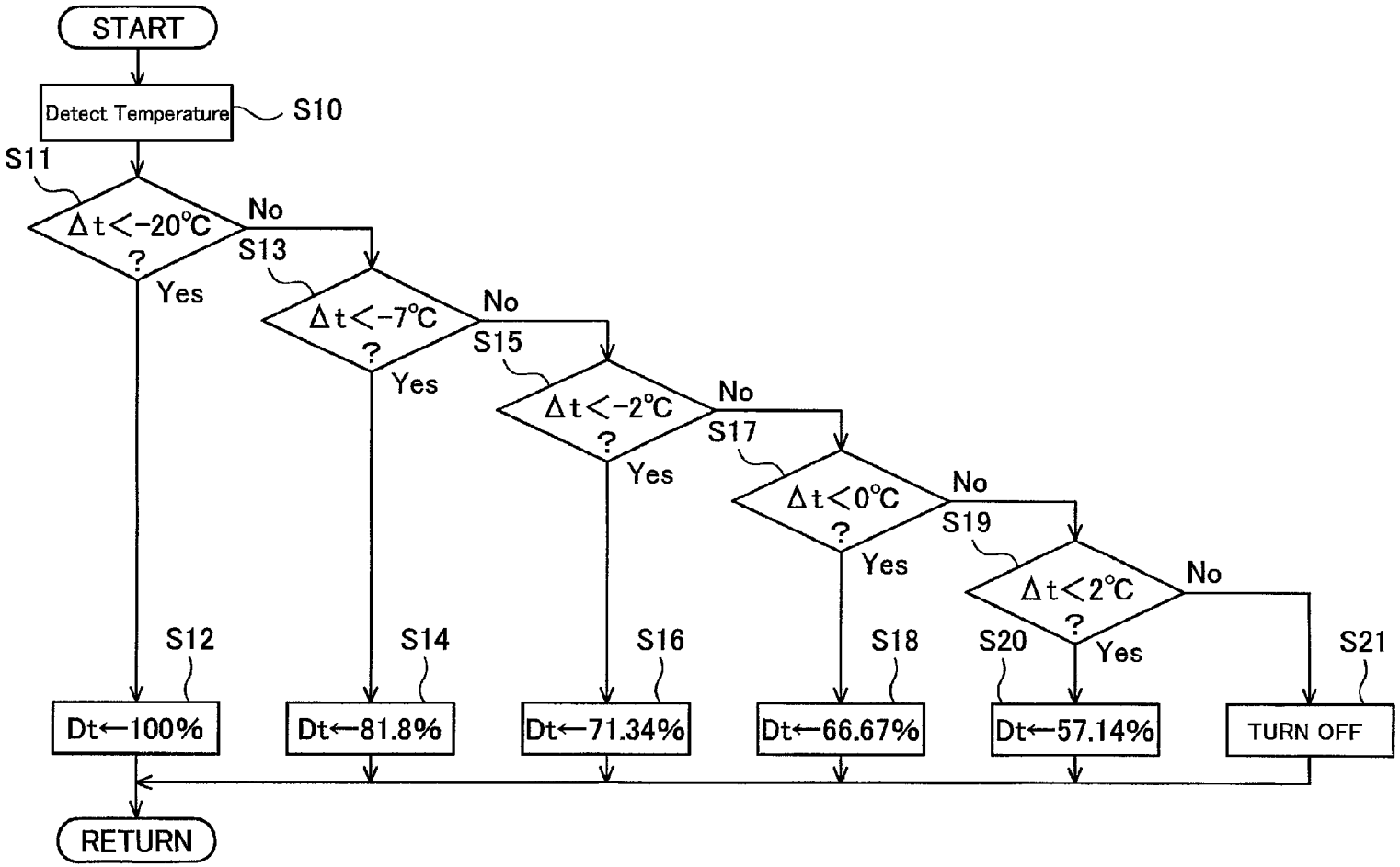
FIG. 5 is a flow chart showing the temperature control of a fixing heater.

In what follows, the temperature control of the fixing heater 53 according to the present embodiment will be explained. FIG. 5 is a flow chart showing the temperature control of the fixing heater 53. The process shown in the flow chart is performed by the control unit 70 in a predetermined cycle.

First, in step 10 (S10), the control unit 70 reads a detection signal output from the temperature sensor 55.

In step 11 (S11), the control unit 70 calculates a temperature difference Δt by subtracting the target temperature for controlling the fixing process from the temperature detected by the temperature sensor 55. The control unit 70 then determines whether or not this temperature difference Δt is smaller than −20° C. If the determination is in the affirmative in step 11, i.e., if the temperature difference Δt is smaller than −20° C. (Δt<−20° C.), the process proceeds to step 12 (S12). Conversely, if the determination is in the negative in step 11, the process proceeds to step 13 (S13).

In step 12, the control unit 70 sets the duty cycle to 100%, and controls the switching unit 54 in accordance with this duty cycle to turn on the fixing heater 53.

In step 13, the control unit 70 determines whether or not the temperature difference Δt is smaller than −7° C. If the determination is in the affirmative in step 13, i.e., if the temperature difference Δt is smaller than −7° C. (Δt<−7° C.), the process proceeds to step 14 (S14). Conversely, if the determination is in the negative in step 13, the process proceeds to step 15 (S15).

In step 14, the control unit 70 sets the duty cycle to 81.8%, and reads an energization pattern corresponding to this duty cycle from the storing unit 71. The control unit 70 then controls the switching unit 54 to switch in accordance with the energization pattern corresponding to this 81.8% duty cycle to turn on the fixing heater 53.

In step 15, the control unit 70 determines whether or not the temperature difference Δt is smaller than −2° C. If the determination is in the affirmative in step 15, i.e., if the temperature difference Δt is smaller than −2° C. (Δt<−2° C.), the process proceeds to step 16 (S16). Conversely, if the determination is in the negative in step 15, the process proceeds to step 17 (S17).

In step 16, the control unit 70 sets the duty cycle to 71.34%, and reads an energization pattern corresponding to this duty cycle from the storing unit 71. The control unit 70 then controls the switching unit 54 to switch in accordance with the energization pattern corresponding to this 71.34% duty cycle to turn on the fixing heater 53.

In step 17, the control unit 70 determines whether or not the temperature difference Δt is smaller than 0° C. If the determination is in the affirmative in step 17, i.e., if the temperature difference Δt is smaller than 0° C. (Δt<0° C.), the process proceeds to step 18 (S18). Conversely, if the determination is in the negative in step 17, the process proceeds to step 19 (S19).

In step 18, the control unit 70 sets the duty cycle to 66.67%, and reads an energization pattern corresponding to this duty cycle from the storing unit 71. The control unit 70 then controls the switching unit 54 to switch in accordance with the energization pattern corresponding to this 66.67% duty cycle to turn on the fixing heater 53.

In step 19, the control unit 70 determines whether or not the temperature difference Δt is smaller than 2° C. If the determination is in the affirmative in step 19, i.e., if the temperature difference Δt is smaller than 2° C. (Δt<2° C.), the process proceeds to step 20 (S20). Conversely, if the determination is in the negative in step 19, the process proceeds to step 21 (S21).

In step 20, the control unit 70 sets the duty cycle to 57.14%, and reads an energization pattern corresponding to this duty cycle from the storing unit 71. The control unit 70 then controls the switching unit 54 to switch in accordance with the energization pattern corresponding to this 57.14% duty cycle to turn on the fixing heater 53.

In step 21, the control unit 70 outputs an OFF signal to the switching unit 54 to turn off the fixing heater 53.

As has been discussed above, in accordance with the present embodiment, the fixing unit 50 of the image forming apparatus comprises the fixing heater 53 to be turned on by energization and perform thermal fixing, the power line which connects the fixing heater 53 with the AC power source AC, the switching unit 54 which switch between an off-state in which the fixing heater 53 is disconnected from the AC power source AC to stop energization and an on-state in which the fixing heater 53 is connected with the AC power source AC to perform energization, and the control unit 70 which controls the switching unit 54 to switch in accordance with one of the plurality of energization patterns each of which defines arrangement of the on-state and the off-state in units of the half wave period of the AC power source AC. Each energization pattern consists of a three or more odd number of the half wave periods arranged in one control cycle, and all the half wave periods of the smaller in number of the ON periods corresponding to the on-state and the OFF periods corresponding to the off-state are not successively arranged.

In accordance with this configuration, the control unit 70 controls the switching unit 54 to switch in accordance with an energization pattern corresponding to a control cycle which contains a three or more odd number of the half wave periods. By this rule, since energization patterns consisting of an even number of the half wave period are excluded, it is possible to avoid such a situation that a larger amount of current flows in a particular direction than in the other direction, and thereby inhibit troubles which may occur in a switching device of the switching unit 54 or the like. Also, since the ON periods and the OFF periods contained in each energization pattern are arranged in an appropriate order, effects of inhibiting flickers can be expected.

Furthermore, in the case of the present embodiment, each energization pattern having a control cycle which is seven or more times the half wave period consists of a first block which consists of three half wave periods including one half wave period of the smaller in number of the ON periods and the OFF periods, and two or more second blocks each of which consists of two half wave periods. Of the second blocks, the number of blocks including a half wave period of the smaller in number of the ON periods and the OFF periods is one or two.

In accordance with this configuration, since the ON periods and the OFF periods contained in each energization pattern having a control cycle which is seven or more times the half wave period are arranged in an appropriate order, effects of inhibiting flickers can be expected.

Needless to say, the above energization patterns of the present embodiment are provided only for illustrative purpose, and it is possible to permute the first block and the two or more second blocks in one control cycle. It is required only that one control cycle consists of the first block and the two or more second blocks satisfying the above requirements.

Figure 6:
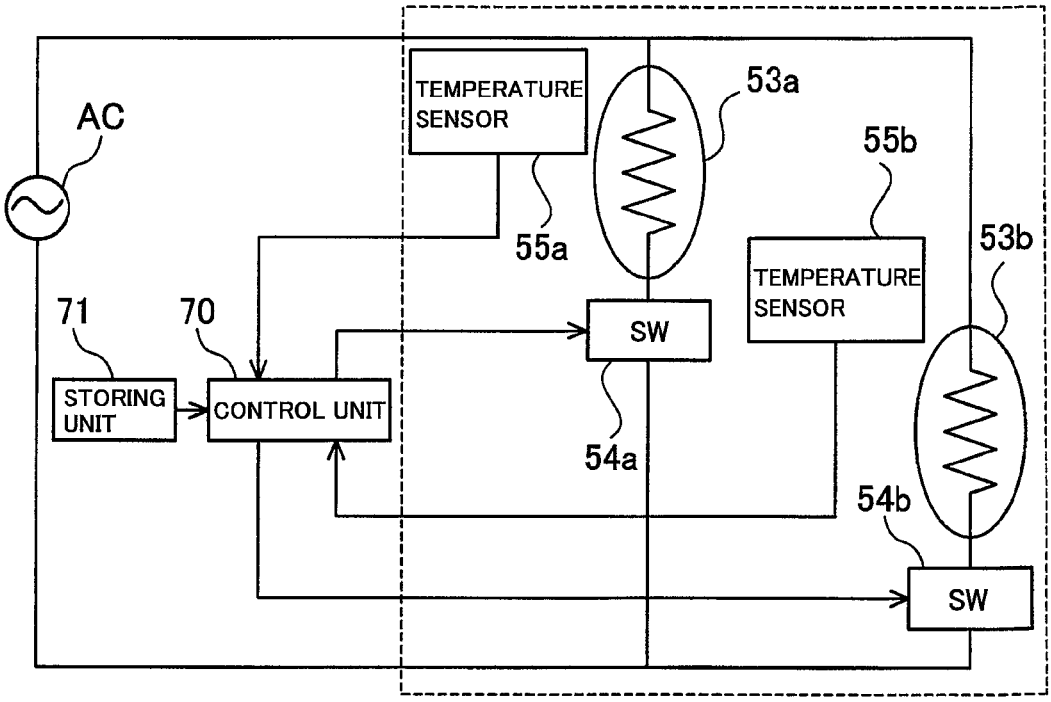
FIG. 6 is a block diagram showing the structure of a fixing unit according to a second embodiment.

FIG. 6 is a block diagram for showing the configuration of a fixing unit 50 of a second embodiment. The image forming apparatus of the present embodiment differs from that of the first embodiment in the configuration of the fixing unit 50. The second embodiment will be explained below mainly with respect to the differences from the first embodiment without repeating redundant description.

Specifically, in accordance with the present embodiment, the fixing heater 53 consists of two heaters 53*a* and 53*b*. These heaters 53*a* and 53*b* are connected in parallel to an AC power source AC respectively through a power line. Furthermore, these heaters 53*a* and 53*b* are provided with switching units 54*a* and 54*b* and temperature sensors 55*a* and 55*b* respectively.

The control unit 70 of the present embodiment determines whether to turn on/off the heaters 53*a* and 53*b* on the basis of the temperature detected by the temperature sensor 55*a* and 55*b*. When turning on the two heaters 53*a* and 53*b*, the control unit 70 separately controls the states of the switching units 54*a* and 54*b* respectively in units of the half wave period of the AC power.

One of the characteristic features of the present embodiment resides in that, when the two heaters 53*a* and 53*b* are turned on at the same time, the control unit 70 controls the switching units 54*a* and 54*b* in order not to synchronize the timings of energizing the heaters 53*a* and 53*b* in accordance with the same energization pattern.

As shown in FIG. 4, when one of the energization patterns 2, 4, 5 and 7 is used to a single heater, the flicker regulation can be satisfied. However, even when one of the energization patterns 2, 4, 5 and 7 is used, the flicker regulation may not be satisfied if a plurality of heaters are turned on at the same time. The inventors of the present invention made an investigation into this issue, and then found that the problem originates from the same energization pattern applied to a plurality of heaters in the same control cycle and in the same phase.

The control unit 70 of the present embodiment thereby controls the switching units 54*a* and 54*b*, when the two heaters 53*a* and 53*b* are turned on at the same time, in order not to synchronize the timings of energizing the heaters 53*a* and 53*b* in accordance with the same energization pattern.

The synchronization can be avoided, for example, by permuting the periods of an energization pattern in order to satisfy the above rules to provide a plurality of energization patterns having the same duty cycle and applying different ones of these energization patterns to the heaters 53*a* and 53*b* respectively. Alternatively, the synchronization can be avoided, for example, by applying the same energization pattern to the heaters 53*a* and 53*b* but with different phases respectively. Namely, the control cycle starts with different timings to avoid synchronization.

As has been discussed above, when the two heaters 53*a* and 53*b* are turned on at the same time, the control unit 70 of the present embodiment controls the switching units 54*a* and 54*b* to switch in accordance with different energization patterns respectively.

This configuration can prevent the heaters 53*a* and 53*b* from switching in synchronization with each other, and thereby it is possible to inhibit the situation that flicker regulation is not satisfied. On the other hand, the energization pattern applied to each of the heaters 53*a* and 53*b* satisfies the rules of the first embodiment, and therefore effects of inhibiting flickers can be expected.

Incidentally, in accordance with the technical concept of the present embodiment, the number of heaters used as the fixing heater 53 is not limited to two but can be three or more.

Also, in accordance with the present embodiment, the switching unit 54 is controlled to switch every 10 msec. Alternatively, zero crossing may be detected as a trigger for controlling the switching unit 54 to switch.

The foregoing description has been presented on the basis of the image forming apparatus according to the present invention. However, it is not intended to limit the present invention to the precise form described, and obviously many modifications and variations are possible within the scope of the invention. For example, while the above embodiments have been explained with the control unit of the image forming apparatus serves also as the control unit of the fixing unit, a dedicated control unit can be provided for the fixing unit in order to perform the temperature control as described above separately from the control unit of the image forming apparatus. Furthermore, the present invention can be considered to relate also to the fixing unit itself.

What is claimed is:

1. A fixing unit comprising:

a fixing heater configured to be turned on by energization and to perform thermal fixing;

a power line configured to connect the fixing heater with an AC power source;

a switching unit configured to switch between an off-state in which the fixing heater is disconnected from the AC power source to stop energization and an on-state in which the fixing heater is connected with the AC power source to perform energization; and a control unit configured to control the switching unit to switch in accordance with one of a plurality of energization patterns each of which defines an arrangement of the on-state and the off-state in units of the half wave period of the AC power source, wherein each of the energization patterns consists of a three or more odd number of the half wave periods arranged in one control cycle, and all the half wave periods of the smaller in number of the ON periods corresponding to the on-state and the OFF periods corresponding to the off-state are not successively arranged, wherein the fixing heater consists of a plurality of heaters which are connected in parallel to the AC power source respectively through the power line, wherein the switching unit is provided separately for each of the plurality of heaters, and wherein when the plurality of heaters are turned on at the same time, the control unit controls the switching unit to turn on/off the plurality of heaters in accordance with different ones of the energization patterns, respectively.

2. The fixing unit of claim 1, wherein when the length of one control cycle is seven or more times the half wave period, the energization pattern having said control cycle comprises:

a first block which consists of three half wave periods including one half wave period of the smaller in number of the ON periods and the OFF periods; and two or more second blocks each of which consists of two half wave periods, and wherein of the second blocks, the number of blocks including a half wave period of the smaller in number of the ON periods and the OFF periods is one or two.

3. An image forming apparatus comprising:

an image forming unit configured to transfer an image to a sheet; and a fixing unit configured to fix the image transferred by the image forming unit to the sheet, wherein the fixing unit comprises:

a fixing heater configured to be turned on by energization and to perform thermal fixing;

a power line configured to connect the fixing heater with an AC power source;

a switching unit configured to switch between an off-state in which the fixing heater is disconnected from the AC power source to stop energization and an on-state in which the fixing heater is connected with the AC power source to perform energization; and a control unit configured to control the switching unit to switch in accordance with one of a plurality of energization patterns each of which defines an arrangement of the on-state and the off-state in units of the half wave period of the AC power source, wherein each of the energization patterns consists of a three or more odd number of the half wave periods arranged in one control cycle, and all the half wave periods of the smaller in number of the ON periods corresponding to the on-state and the OFF periods corresponding to the off-state are not successively arranged, wherein the fixing heater consists of a plurality of heaters which are connected in parallel to the AC power source respectively through the power line, wherein the switching unit is provided separately for each of the plurality of heaters, and wherein when the plurality of heaters are turned on at the same time, the control unit controls the switching unit to turn on/off the plurality of heaters in accordance with different ones of the energization patterns, respectively.

4. The image forming apparatus of claim 3, wherein when the length of one control cycle is seven or more times the half wave period, the energization pattern having said control cycle comprises:

a first block which consists of three half wave periods including one half wave period of the smaller in number of the ON periods and the OFF periods; and two or more second blocks each of which consists of two half wave periods, and wherein of the second blocks, the number of blocks including a half wave period of the smaller in number of the ON periods and the OFF periods is one or two.

5. The image forming apparatus of claim 3, further comprising a storing unit configured to store the plurality of energization patterns.

* * * * *